US005919386A

United States Patent [19]

James

[11] Patent Number: 5,919,386

[45] Date of Patent: Jul. 6, 1999

[54] PURGE MANAGEMENT SYSTEM FOR GAS PURGED IMMERSION HEATERS

[75] Inventor: Joseph E. James, Streetsboro, Ohio

[73] Assignee: Lufran Incorporated, Streetboro, Ohio

[21] Appl. No.: 08/872,903

[22] Filed: Jun. 11, 1997

Related U.S. Application Data

[60] Provisional application No. 60/020,446, Jun. 18, 1996.

[51] Int. Cl.[6] ..... H05B 3/06; H05B 3/78; H05B 3/40

[52] U.S. Cl. ..... 219/523; 219/544; 219/549; 392/497; 392/501; 392/503

[58] Field of Search ..... 219/523, 385, 219/438; 392/441, 448, 489, 497, 501, 503; 156/85

[56] References Cited

U.S. PATENT DOCUMENTS 4,158,764 6/1979 Yane .
4,553,024 11/1985 Findlay .
4,835,365 5/1989 Etheridge .
5,021,151 6/1991 Yane .
5,224,503 7/1993 Thompson et al. .

*Primary Examiner*—Teresa Walberg
*Assistant Examiner*—Thor S. Campbell
*Attorney, Agent, or Firm*—Fay, Sharpe, Beall, Fagan Minnich & McKee

[57] ABSTRACT

A purge manifold assembly, which can be used in a gas purged immersion heater, includes a housing having a vessel wall having an aperture extending therethrough. A purge manifold is located adjacent the vessel wall. The purge manifold includes an aperture extending therethrough and colinear with the vessel wall aperture, a bore extending in the purge manifold, in a direction approximately normal to the purge manifold aperture, and a port communicating the bore with the purge manifold aperture. A fitting body extends into the vessel wall aperture and the purge manifold aperture. The fitting body includes a longitudinally extending through bore and a port communicating with the through bore. The port also communicates with the port of the purge manifold. In this way, a purge gas is allowed to flow through a sheath enclosing a heater wire held in the housing of the gas purged immersion heater.

28 Claims, 7 Drawing Sheets

PURGE MANAGEMENT SYSTEM FOR GAS PURGED IMMERSION HEATERS

This application bases its priority on provisional application Serial No. 60/020,446 which was filed on Jun. 18, 1996.

BACKGROUND OF THE INVENTION

The present invention relates to immersion heaters for heating a liquid in a bath. More particularly, the invention relates to a purge management system for a gas purged immersion heater.

Electrical resistance heaters formed of a continuous flexible cable are particularly suitable for immersion in corrosive chemical baths since the exterior of the flexible cable may be jacketed with a suitable plastic material having satisfactory resistance to the corrosive nature of the chemical bath being heated. An example of a flexible cable resistance heater is shown and described in U.S. Pat. No. 4,158,764. This patent is incorporated herein by reference in its entirety.

It is known to provide such flexible cable heaters with an outer casing or jacket formed of polytetrafluoroethylene (PTFE) material. PTFE has satisfactory resistance to chemical attack by corrosive media. However, it has the disadvantage that when employed in a thin walled tube for desired flexibility, the permeability of PTFE permits transmigration of heated chemical vapor into the interior of the cable heater. To overcome this problem, U.S. Pat. No. 4,553,024 discloses that the outer jacket of the cable-type immersion heater can be connected to a suitable source of a dry gaseous medium for circulation from an inlet end of the heater cable through the interior of the heater cable, and over the heating element, to an exhaust at the opposite end of the heater cable. This provides a continuous dry gas flow or purge over the resistance heating element to scavenge any accumulated corrosive chemical vapors which may have permeated through the outer plastic jacket of the heater cable. Pat. No. 4,553,024 is also incorporated herein by reference in its entirety.

The currently available system for manifolding the gas purge of the gas purged heater has been to utilize commonly available compression fittings to allow for the separation of the power cables from the purge medium. In the known system, a "T" style fitting is used wherein the power leads remain in the same axial line as the heater sheath itself. The purge medium is then introduced through the portion of the "T" that is at a right angle to the power lead. Although the currently available system is very cost effective in terms of production costs of the heater itself, the installation costs to the final customer are relatively high. In certain cases, it has been found that the customer does not make the necessary connections due to the complexity of the known system. The current design is also disadvantageous from the standpoint that it requires a great deal of space for the installation of the "T" style fittings. The amount of room required to make all the necessary connections can, in most instances, be better utilized for other support systems of the gas purged heater or to make the final heater installation smaller. This minimizes the use of valuable space, such as in a clean room in which the fabrication of electronic microchips takes place.

Accordingly, it has been considered desirable to develop a new and improved purge management system for gas purged water heaters which would overcome the foregoing difficulties and others while providing better and more advantageous overall results.

BRIEF SUMMARY OF THE INVENTION

The present invention provides a compact, easy to connect apparatus which supplies power and a purge medium to a gas purged immersion heater system for heating a fluid.

According to one aspect of the present invention, a purge manifold assembly is provided.

More particularly in accordance with this aspect of the invention, the purge manifold assembly comprises a vessel wall having an aperture extending therethrough and a purge manifold located adjacent the vessel wall. The purge manifold comprises an aperture extending therethrough and colinear with the vessel wall aperture, a bore extending in the purge manifold and a port communicating the bore with the purge manifold aperture. A fitting body extends into the vessel wall aperture and the purge manifold aperture. The fitting body comprises a longitudinally extending through bore and a port communicating with the through bore. The fitting body port also communicates with the port of the purge manifold.

In accordance with another aspect of the present invention, a gas purged immersion heater is provided.

More particularly in accordance with this aspect of the invention, the gas purged immersion heater comprises a housing including a vessel wall and a purge manifold located adjacent the vessel wall, wherein the vessel wall includes an aperture extending therethrough. The purge manifold comprises an aperture extending therethrough and colinear with the vessel wall aperture, a bore extending in the purge manifold approximately normal to the purge manifold aperture and a port communicating the bore with the purge manifold aperture. A sheath extends into the fitting body and terminates short of the port therein and a lead wire extends through the fitting body.

In accordance with still another aspect of the present invention, a fluid heating system is provided.

More particularly in accordance with this aspect of the invention, the fluid heating system comprises a housing having an interior chamber in which extends a sheath enclosing a heater wire. A system fluid inlet allows a system fluid to flow into the chamber and a system fluid outlet allows the system fluid to flow out of the chamber. The housing also includes a purge gas inlet for allowing purged gas to flow into the sheath and a purge gas outlet for allowing the purge gas to flow out of the sheath. Finally, the housing includes a power conduit inlet for allowing a power cable to be in electrical contact with the heater wire.

One advantage of the present invention is the provision of a new and improved purge management system for a gas purged flexible cable-type immersion heater.

Another advantage of the present invention is the provision of an inline type gas purged flexible cable-type heater for fluids such as corrosive fluids.

Still another advantage of the present invention is the provision of a purge management system employing a purge chamber for connecting a plurality of separate purging systems—for separate heater cables—to a common manifold through which the purging gas can flow.

A further advantage of the present invention is the provision of a purge management system which employs a compression fitting that allows for the separation of the electrical power lines from the purging medium flow paths of the immersion heater system.

A yet further advantage of the present invention is the provision of a purge management system employing a fitting which provides sealing surfaces for external fluid that is heated by the heater, for internal purge fluid and for the power leads to the heating element.

Still other benefits and advantages of the invention will become apparent to those of average skill in the art upon a reading and understanding of the following detailed specification.

BRIEF DESCRIPTION OF THE DRAWINGS

The invention may take physical form in certain parts and arrangements of parts preferred embodiments of which will be described in detail in this specification and illustrated in the accompanying drawings which form a part hereof and wherein.

DETAILED DESCRIPTION OF THE PREFERRED EMBODIMENTS

Figure 1:
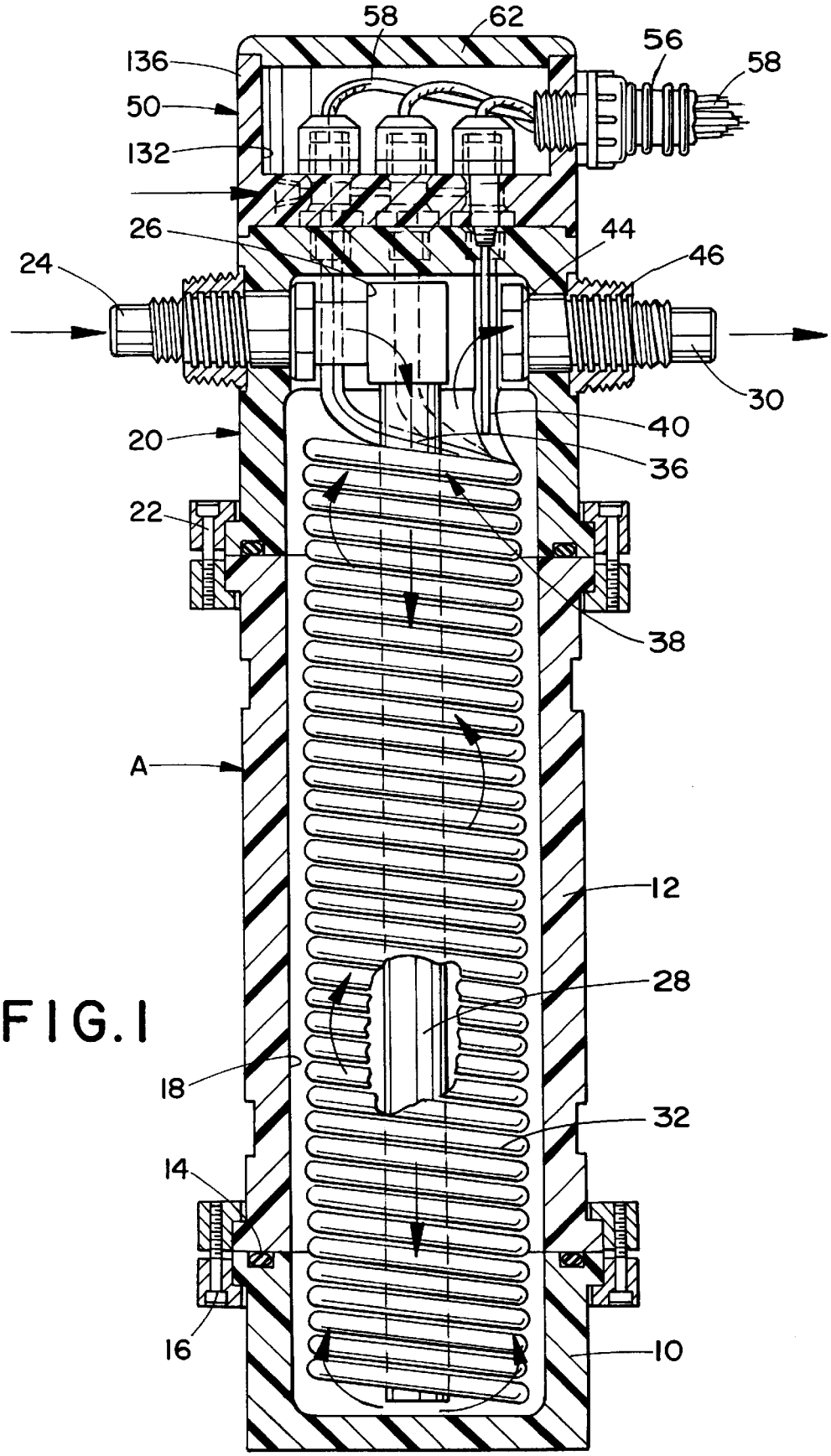
FIG. 1 is a side elevational view, partially in cross-section, of a purge management system for a gas purged immersion heater apparatus according to a first preferred embodiment of the present invention.

Referring now to the drawings wherein the showings are for purposes of illustrating several preferred embodiments of the invention only and not for purposes of limiting same, FIG. 1 shows the purge management system for a gas purged immersion heater apparatus A. The apparatus includes a housing which comprises a bottom section 10 and a central section 12. These two elements have a seal 14 between them. A clamp means 16 holds the two sections together. A chamber 18 is defined within the central and bottom sections. A top section 20 is fastened by a clamp means 22 to the central section 12. Defined in the top section is an inlet 24 which leads to a header 26. Extending towards the bottom section 10 and centrally disposed within the chamber 18 is an inlet distribution pipe 28 secured at its upper end to the header. Communicating with the header is an outlet 30. Coiled within the chamber 18 are a plurality of gas purged flexible cable heaters 32 of the type which is disclosed in U.S. Pat. No. 4,553,024. It should be appreciated that three separate cable heaters 32 are coiled together in the chamber 18.

Figure 7:
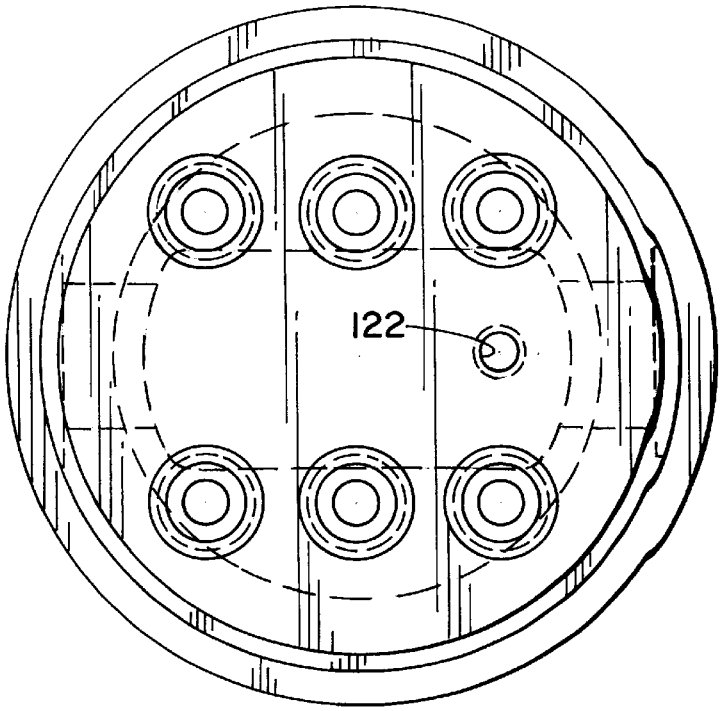
FIG. 7 is a top plan view of a top section of the purge management system of FIG. 1.
Figure 8:
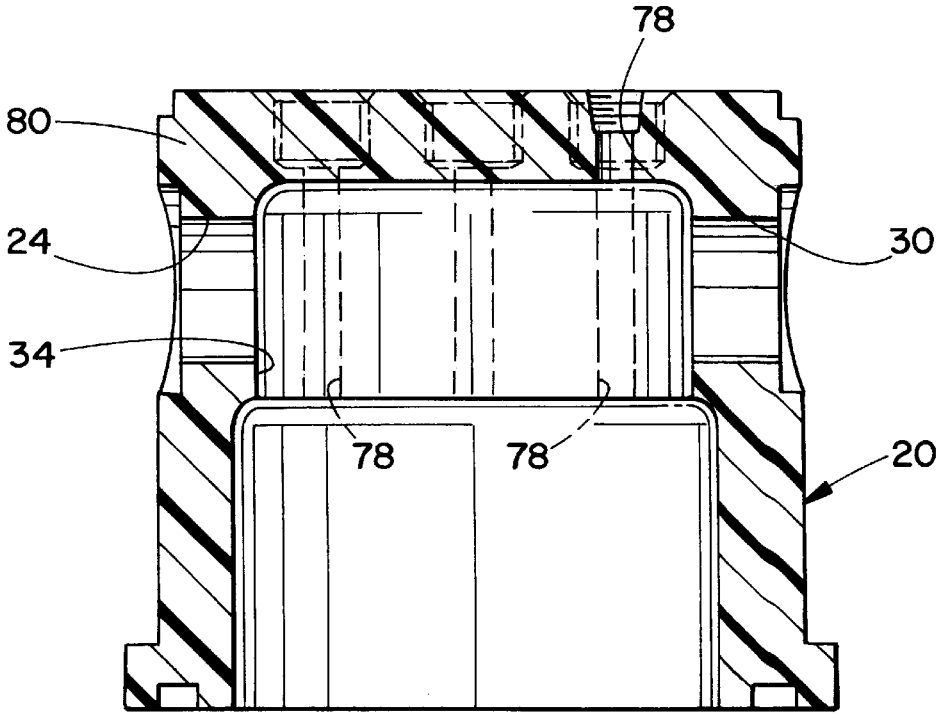
FIG. 8 is a side elevational view in cross-section of the top section of FIG. 7.
Figure 9:
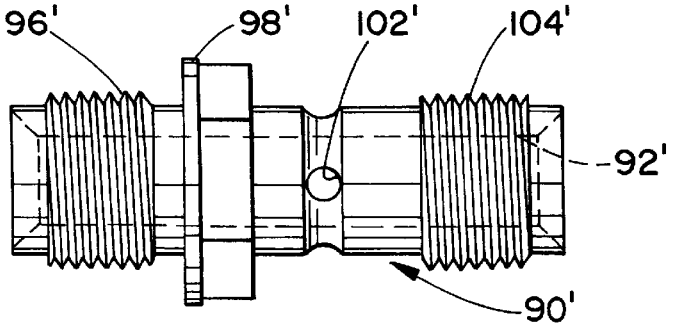
FIG. 9 is an enlarged side elevational view of a fitting body of a purge management system according to a second preferred embodiment of the present invention.
Figure 10:
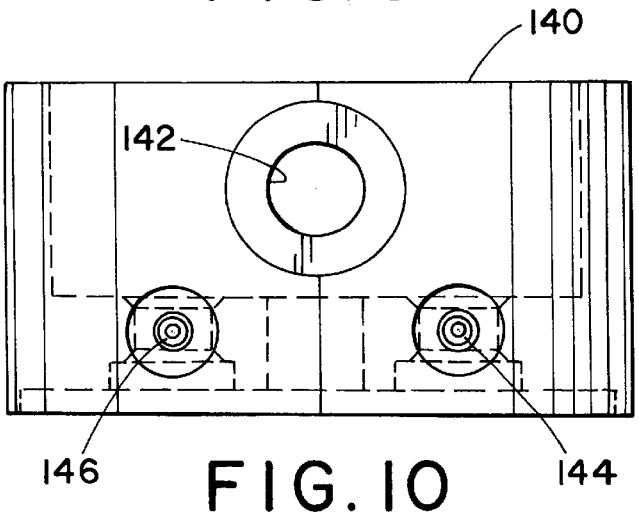
FIG. 10 is an end elevational view of a purge chamber section of a purge management system according to the second preferred embodiment of the present invention.

The header 26 is located in a central opening 34 in the top section which is best illustrated in FIGS. 7 and 8. An over temperature thermocouple 36 is provided on at least one of the flexible cable heaters 32. Also, a thermal cut off eutectic fuse 38 can be provided if desired. A control thermocouple 40 extends within the chamber 18 to regulate the heating function of the cable heaters 32.

At both the inlet 24 and the outlet 30, there is provided a seal 44. If desired, the seal can be a Teflon encapsulated O-ring face seal. In addition, at both the inlet 24 and the outlet 30, a double containment adaptor fitting 46 can be provided if desired. The inlet 24 and outlet 30 can each be of a suitable conventional type, such as a "Purebond" pipe connection or a "Flaretek" connection.

Figure 4:
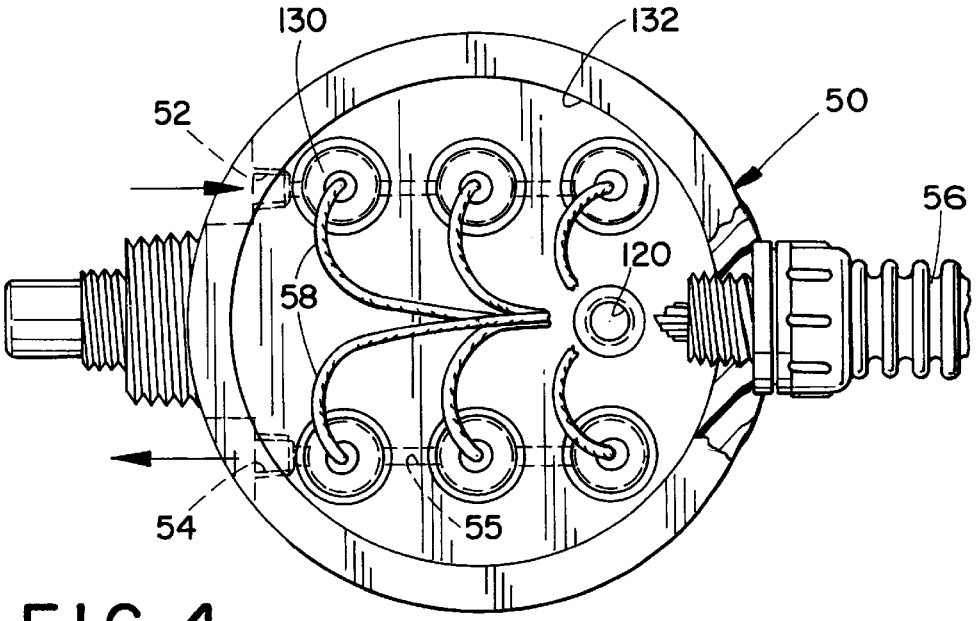
FIG. 4 is a top plan view of the purge management system of FIG. 1 with a cap thereof removed.
Figure 6:
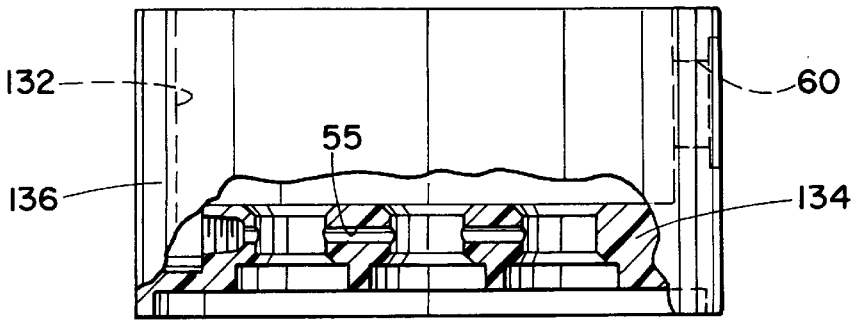
FIG. 6 is a side elevational view in cross-section of the purge chamber of FIG. 5.

Fastened by suitable means to the top section 20 is a purge chamber 50. With reference now also to FIG. 4, the purge chamber 50 comprises a purge inlet 52 and a purge outlet 54. As illustrated in FIG. 6, each of the inlet and outlet includes a bore 55 which communicates with several through openings in a base wall of the purge chamber. With reference again to FIG. 1, a power conduit 56 is fastened to the purge chamber 50 such that a plurality of power lines 58 can extend through a side opening 60 (see FIG. 6) in the purge chamber. A cap 62 can be suitably fastened to the purge chamber 50 in order to enclose the top thereof.

Figure 2:
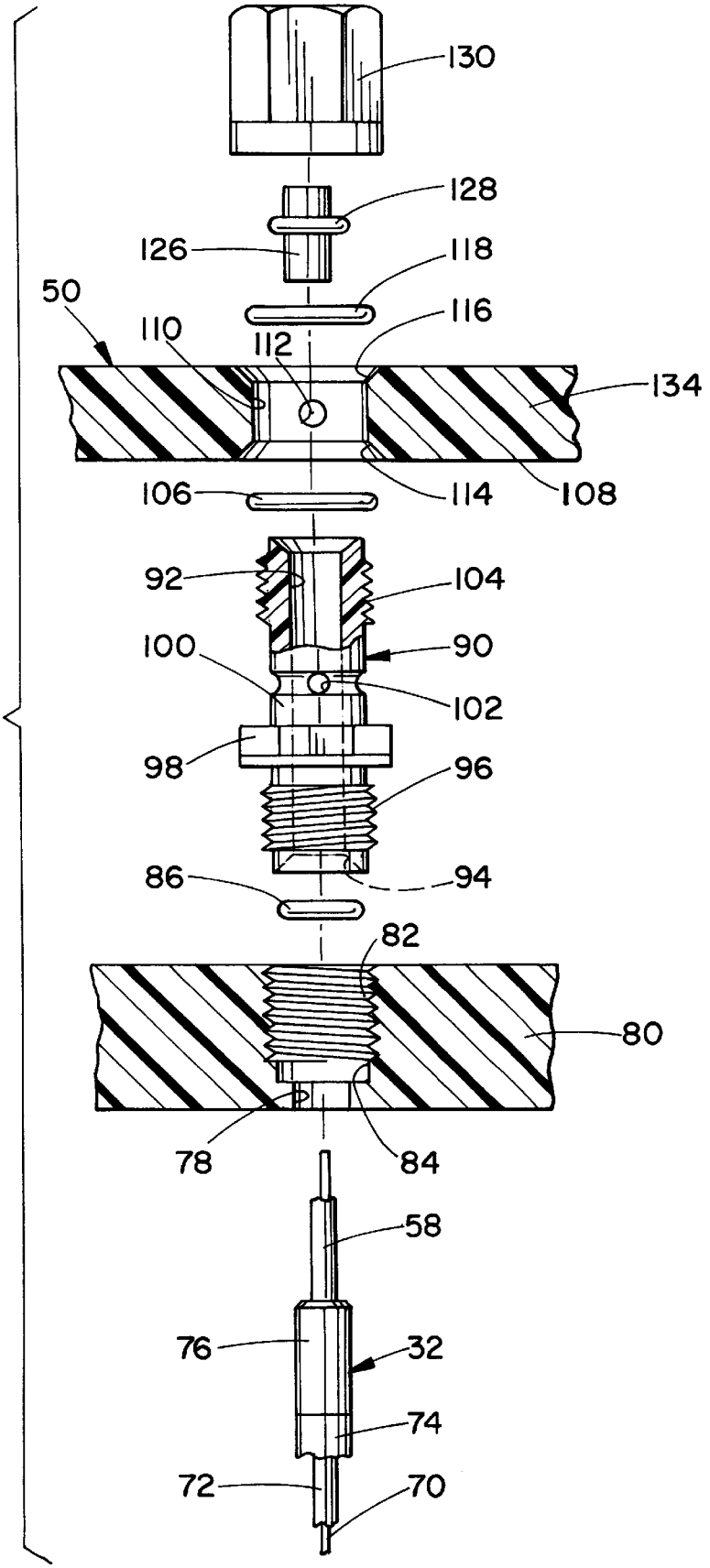
FIG. 2 is a greatly enlarged exploded side elevational view of a portion of the purge management system of FIG. 1.

With reference now to FIG. 2, the gas purge flexible cable heater 32 includes a heater wire 70 which is fastened at one end to a power lead 72. Both of these are enclosed in a heater sheath 74 that is fastened to a sheath support tube 76. Extending out of the sheath support tube is one of the power lines 58. The power line extends through a bore 78 of an end wall 80 (see FIG. 8) of the top section 20. The bore 78 includes a threaded section 82 and an unthreaded section 84 of substantially the same diameter. When assembled, a seal 86 (preferably an O-ring) is located in the unthreaded section 84 of the bore and is contacted by one end of a fitting body 90. The fitting body includes a longitudinally extending through bore 92 having a first angular end face 94 which presses against the seal 86. The fitting body includes a first threaded peripheral section 96 which is adapted to seat in the threaded section 82 of the bore 78 in the end wall 80. The fitting body also includes a flange 98 which contacts a distal side of the end wall 80.

Figure 3:
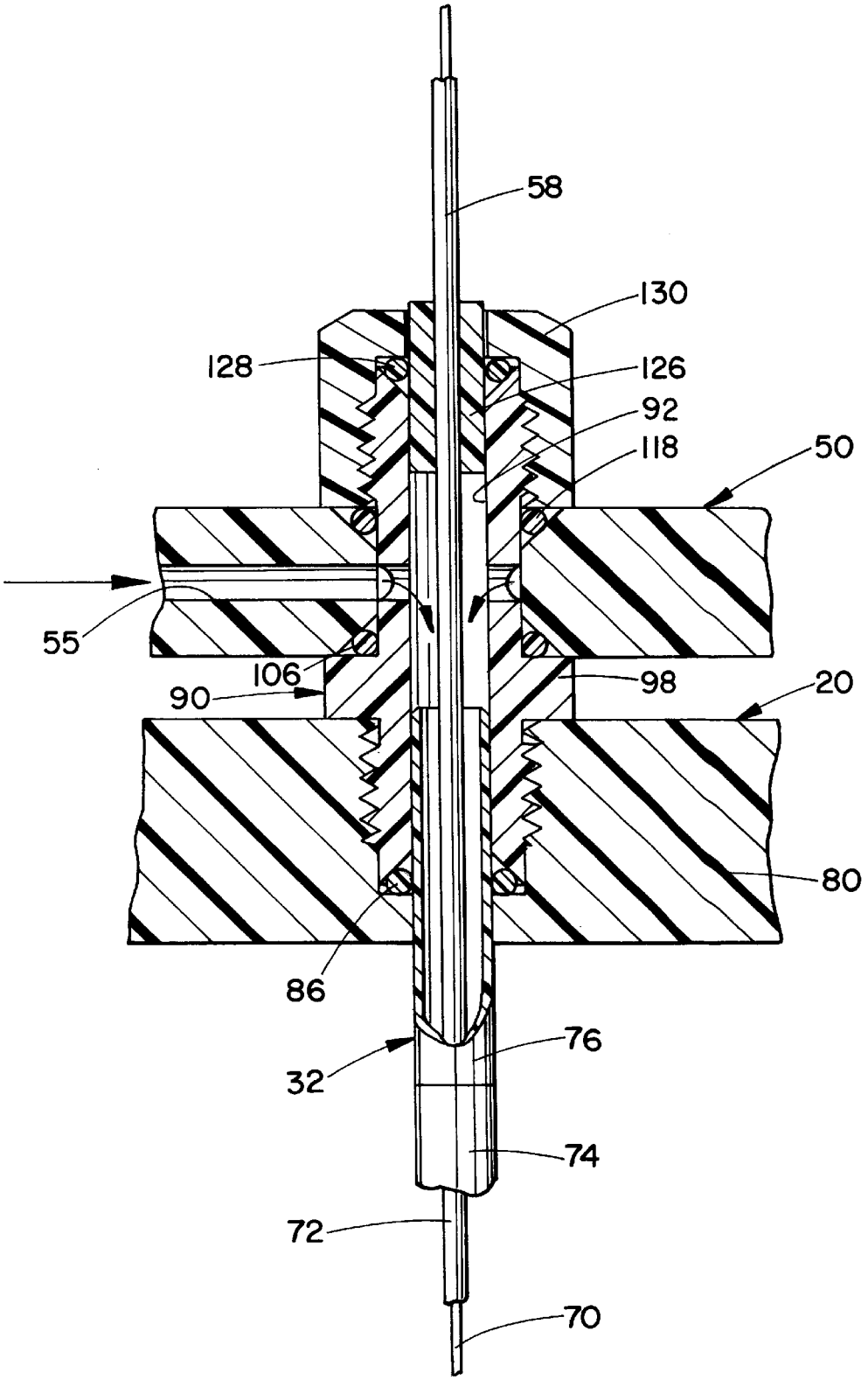
FIG. 3 is an assembled view of the portion of the purge management system of FIG. 2.

Adjacent the flange 98 is a reduced diameter section 100 in the fitting body. Located in the reduced diameter section is a port 102 which communicates with the longitudinal bore 92 of the fitting body 90. Positioned adjacent the reduced diameter section 100 is a second threaded peripheral section 104 of the fitting body. Slipped over the second threaded section of the fitting body and contacting the distal side of the flange 98 when in an assembled condition, as illustrated in FIG. 3, is a first purge manifold seal 106. The seal 106 also contacts an end wall 108 of the purge manifold. As shown in FIG. 2, the end wall 108 includes a through opening 110. Communicating with the opening 110 is a transverse port 112. The port 112 also communicates, via one of the bores 55 (FIG. 6), with one of the purge inlet 52 or the purge outlet 54 (FIG. 5).

When in an assembled condition, the bore 112 communicates with the bore 102 so as to allow the purge fluid to flow out of the heater sheath 74 through the fitting body 90 and out the aperture 102 thereof. The through opening 110 has first and second angled end faces 114 and 116. The first end face 114 captures the first purge manifold seal 106. The second end face 116 captures a second purge manifold seal 118. Extending into the longitudinal bore 92 of the fitting body 90 is a purge/power seal 126. Mounted on the purge/power seal 126 is a purge/power seal O-ring 128. The power seal 126 and O-ring 128 prevent the purge fluid from flowing out the distal end of the fitting body longitudinal bore 92 as is best illustrated in the assembled view of FIG. 3. A fitting cap 130 is threaded over the second threaded peripheral section 104 of the fitting body 90 as is illustrated in FIG. 3. In this way, the second purge manifold seal 118 is captured between the manifold wall 108 and the fitting cap 130 while the first manifold seal 106 is captured between the flange 98 of the fitting body 90 and the manifold end wall 108.

Figure 5:
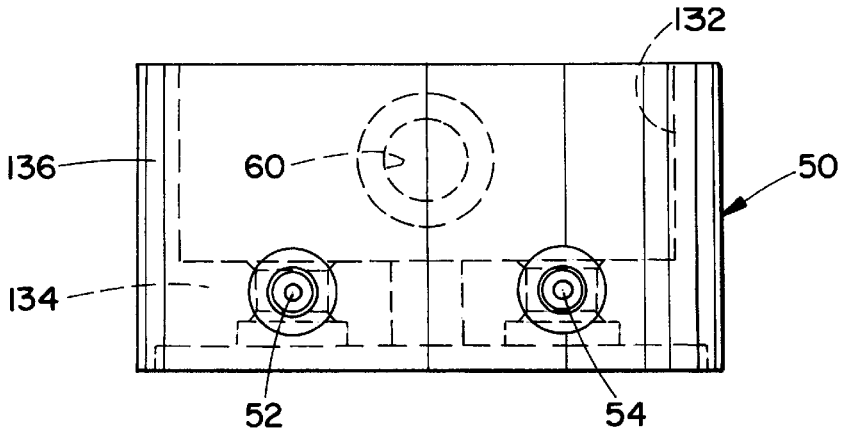
FIG. 5 is an end elevational view of a purge chamber section of the purge management system of FIG. 1.

It is evident from FIGS. 5 and 6 that a central cavity 132 is formed in the purge chamber 50 by a bottom wall 134 which comprises the purge manifold and a peripheral side wall 136. The several fitting caps 130 and the power lines 58 are housed in this cavity. Contact with the power lines 58 is prevented by the presence of the cap 62 sealing the cavity 132.

With reference now also to FIG. 4, an opening 120 extends through the purge chamber 50 for housing the thermocouple 40. Aligned with the opening 120 in the purge chamber 50 is an opening 122 extending through the top section 20, as illustrated in FIG. 7.

With the completed assembly, the user need simply connect the power and purge media using standard connection methods. The power connection can be made by connecting the lead wires to a terminal block or by means of a commonly available electrical plug. The purge media connections can be made via a compression fitting or any other commonly available type of fluid connector such as a "quick coupling" commonly used for compressed air and hydraulic service. The present configuration of the invention also makes provisions for the user to make electrical connections to the heater in a sealed "junction box." This method allows the user to determine the final length of cable required for the particular installation so that an environmental seal can be made in the system. A system of this sort is generally preferred by the user to protect electrical connections from the potentially damaging environment products to which the heater is subjected.

It should be appreciated that any suitable number of gas purged flexible cable heaters 32 could be provided in the heater housing A. While the embodiment disclosed in FIGS. 1–8 illustrates three such gas purged flexible cable heaters—each having a respective end secured by a respective fitting body 90 and fitting cap 130 to the top section end wall 80 and the purge chamber end wall 108 as illustrated in FIG. 3—any other suitable number of cable heaters can be provided.

For example, an embodiment wherein two such gas purged flexible cable heaters are located in a heater housing is illustrated in FIGS. 9–13. For ease of understanding and appreciation of this embodiment of the invention, like components are identified by like numerals with a primed (') suffix and new components are identified by new numerals.

Figure 11:
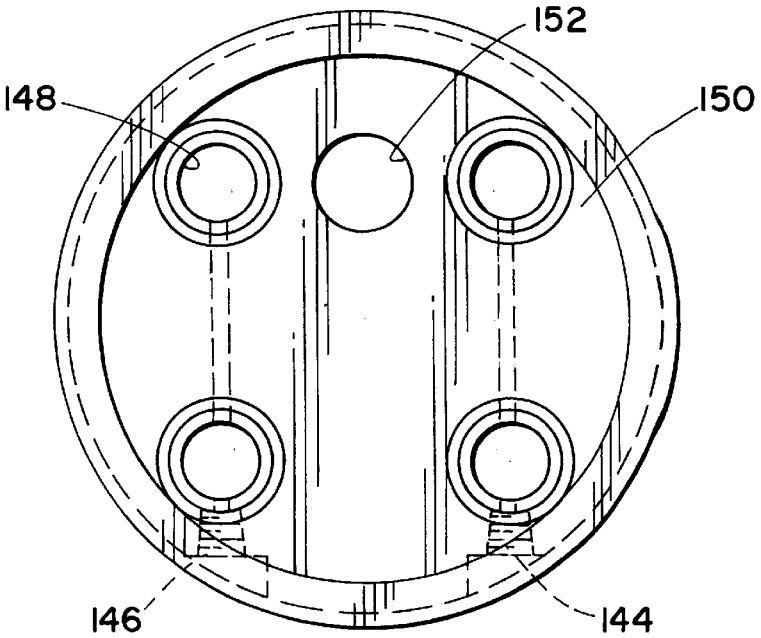
FIG. 11 is a top plan view of the purge chamber of FIG. 10.
Figure 12:
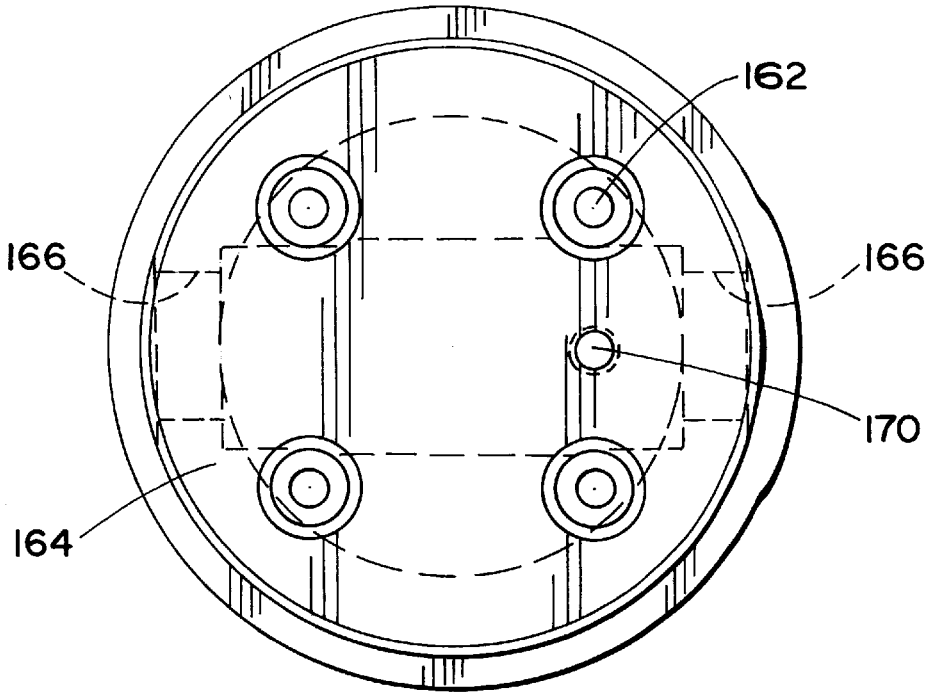
FIG. 12 is a top plan view of a top section of the purge management system according to the second preferred embodiment; and, FIG. 13 is an end elevational view of the top section of FIG. 12.
Figure 13:
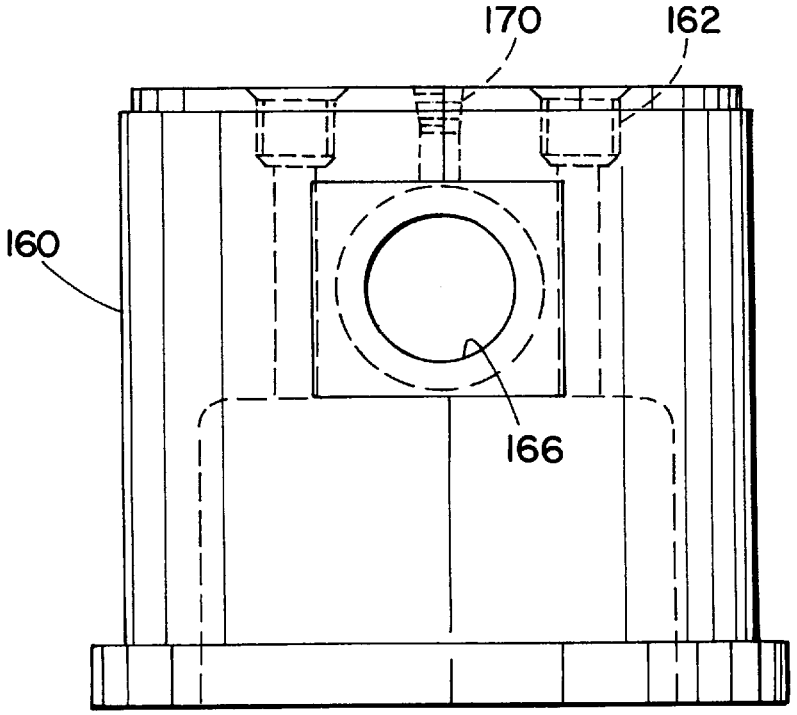

In this embodiment, a purge chamber 140 also has an opening 142 (see FIG. 10) for accommodating the power lines of the cable heaters and a purge inlet 144 as well as a purge outlet 146. As is illustrated in FIG. 11, four through bores 148 extend through an end wall 150 of the purge chamber for accommodating the two ends of each of the flexible cable heaters. Also located in the end wall is a thermocouple opening 152. FIG. 12 illustrates that a top section 160 of a heater housing according to this embodiment of the invention includes four threaded bores 162 through an end wall 164 for accommodating a suitable fitting body 90'. The fitting body comprises first and second threaded sections 96' and 104' as well as a flange 98' and a transverse bore 102' which communicates with a central longitudinally extending bore 92' of the fitting body 90'. The top section 160 includes an inlet 166 and an outlet 168. Aligned with the thermocouple opening 152 in the purge chamber 140 is a thermocouple bore 170 (see FIG. 13) extending through the top section.

The invention has been described with reference to several preferred embodiments. Obviously, alterations and modifications will occur to others upon a reading and understanding of this specification. It is intended to include all such modifications and alterations insofar as they come within the scope of the appended claims or the equivalents thereof.

What is claimed is:

1. A purge manifold assembly, comprising:

a vessel wall having an aperture extending therethrough;

a purge manifold located adjacent said vessel wall, said purge manifold comprising:

an aperture extending therethrough and collinear with said vessel wall aperture, a bore extending in said purge manifold, and a port communicating said bore with said purge manifold aperture, said bore intersecting said aperture at said port; and, a fitting body extending into said vessel wall aperture and said purge manifold aperture, said fitting body comprising:

a longitudinally extending through bore, and a port communicating with said through bore, said fitting body port also communicating with said port of said purge manifold.

2. The assembly of claim 1 wherein said fitting body extends through said purge manifold aperture and further comprising a fitting cap into which said fitting body extends.

3. The assembly of claim 2 further comprising:

a first seal for sealing between said fitting body and said vessel wall; and, a second seal for sealing between said fitting body and said fitting cap.

4. The assembly of claim 3 further comprising:

a third seal for sealing between said fitting body and said purge manifold; and, a fourth seal for sealing between said purge manifold and said fitting cap.

5. The assembly of claim 1 further comprising a flange extending approximately normal to a longitudinal axis of said fitting body, said flange spacing said purge manifold from said vessel wall.

6. The assembly of claim 1 further comprising:

a first means for securing said fitting body to said vessel wall; and, a second means for securing said fitting body in relation to said purge manifold.

7. The assembly of claim 1 further comprising:

a sheath extending into said fitting body and terminating short of said fitting body port; and, a lead wire extending through said fitting body.

8. A gas purged immersion heater comprising:

a housing including a vessel wall and a purge manifold located adjacent said vessel wall, wherein said vessel wall includes an aperture extending therethrough and said purge manifold comprises:

an aperture extending therethrough and collinear with said vessel wall aperture, a bore extending in said purge manifold approximately normal to said purge manifold aperture, and a port communicating said bore with said purge manifold aperture, said bore intersecting said aperture at said port;

a sheath extending into said fitting body and terminating short of said port therein; and, a lead wire extending through said fitting body.

9. The heater of claim 8 wherein said fitting body extends through said purge manifold aperture and further comprising a fitting cap into which said fitting body extends.

10. The heater of claim 9 further comprising:

a first seal for sealing between said fitting body and said vessel wall; and, a second seal for sealing between said fitting body and said fitting cap.

11. The heater of claim 10 further comprising:

a third seal for sealing between said fitting body and said purge manifold; and, a fourth seal for sealing between said purge manifold and said fitting cap.

12. The heater of claim 8 further comprising a flange extending approximately normal to a longitudinal axis of said fitting body, said flange spacing said purge manifold from said vessel wall.

13. The heater of claim 8 further comparing:

a first means for securing said fitting body to said vessel wall; and, a second means for securing said fitting body in relation to said purge manifold.

14. The heater of claim 8 further comprising at least one heater cable extending is said sheath and electrically connected to said lead wire, said heater cable being located in said housing.

15. A fluid heating system comprising:

a housing having an interior chamber;

a sheath enclosing a heater wire, said sheath being located in said housing interior chamber;

a system fluid inlet on said housing for allowing a system fluid to flow into said chamber;

a system fluid outlet on said housing for allowing the system fluid to flow out of said chamber;

a purge gas inlet on said housing for allowing a purge gas to flow into said sheath;

a purge gas outlet on said housing for allowing the purge gas to flow out of said sheath;

a power conduit inlet on said housing for allowing a power cable to be in electrical contact with said heater wire; and, a purge manifold located adjacent said housing, said purge manifold comprising:

an aperture extending through said purge manifold, a bore extending in said purge manifold, and a port communicating said bore with said purge manifold aperture, said bore intersecting said aperture at said port.

16. The system of claim 15 further comprising a purge chamber including:

a base wall;

a peripheral side wall; and, a cavity defined in said purge chamber by said side wall and said base wall.

17. The system of claim 16 wherein said purge manifold is defined in said purge chamber base wall and wherein said aperture extends through said base wall and said bore extends in said base wall in a direction approximately normal to said aperture.

18. The system of claim 15 wherein said housing further comprises a vessel wall having an aperture extending therethrough, said vessel wall aperture being collinear with said purge manifold aperture.

19. The system of claim 18 further comprising:

a fitting body extending into said vessel wall aperture and said purge manifold aperture, said fitting body comprising:

a longitudinally extending through bore, and a port communicating with said through bore, said port also communicating with said port of said purge manifold.

20. The system of claim 19 wherein said fitting body protrudes through said purge manifold aperture and further comprising:

a fitting cap into which said fitting body extends;

a first seal for sealing between said fitting body and said vessel wall; and, a second seal for sealing between said fitting body and said fitting cap.

21. A purge chamber for a gas purged immersion heater comprising:

a body having a bottom wall and a side wall which together define a central cavity;

said bottom wall comprising a purge manifold which comprises:

a first aperture extending transversely therethrough and communicating with said central cavity, a second aperture extending transversely therethrough and communicating with said central cavity, said second aperture being spaced from said first aperture, a first bore extending in said bottom wall between said first and second apertures, a first port communicating said first bore with said first aperture, and a second port communicating said first bore with said second aperture; and, a purge conduit oriented parallel to said first bore and extending radially inwardly from an outer face of said bottom wall so as to communicate with one of said first and second apertures and hence, said first bore.

22. The purge chamber of claim 21 further comprising a side opening extending through said side wall for accommodating a plurality of associated power lines which extend into said central cavity.

23. The purge chamber of claim 21 wherein said purge conduit comprises a purge inlet and further comprising:

a third aperture extending through said bottom wall, said third aperture being spaced from said first and second apertures;

a fourth aperture extending through said bottom wall, said fourth aperture being spaced from said first, second and third apertures;

a second bore extending in said bottom wall between said third and fourth apertures, said second bore being spaced from said first bore;

a third port communicating said second bore with said third aperture; and a fourth port communicating said second bore with said fourth aperture.

24. The purge chamber of claim 23 further comprising a second purge conduit oriented parallel to said second bore and extending radially inwardly from said outer face of said bottom wall so as to communicate with one of said third and fourth apertures and hence, said second bore.

25. The purge chamber of claim 24 wherein said second purge conduit comprises a purge outlet.

26. The purge chamber of claim 21 further comprising a thermocouple opening located in said bottom wall, said thermocouple opening being spaced from said first and second apertures, said thermocouple opening communicating with said central cavity and accommodating an end of an associated thermocouple.

27. The purge chamber of claim 21 further comprising a cap which can be selectively fastened atop said purge chamber to enclose said central cavity thereof.

28. The purge chamber of claim 21 further comprising a peripheral skirt extending downwardly from said bottom wall for positioning said purge chamber on an associated section of the gas purged immersion heater.

* * * * *